United States Patent [19]

Kitamura et al.

[11] Patent Number: 4,718,131

[45] Date of Patent: Jan. 12, 1988

[54] SANITARY FACILITY UNIT

[75] Inventors: Ryuzo Kitamura; Masami Shindo; Masamichi Miyanaga; Yoshimichi Fukuda, all of Tokyo, Japan

[73] Assignees: Toto Ltd., Fukuoka; Tokyo Gas Housing Company, Ltd., Tokyo, both of Japan

[21] Appl. No.: 889,629

[22] Filed: Jul. 28, 1986

[51] Int. Cl.[4] ..... A47K 4/00

[52] U.S. Cl. ..... 4/663; 4/307; 4/312; 4/664; 4/DIG. 2

[58] Field of Search ..... 4/DIG. 2, 664, 663, 4/665, 307, 312, 314, 662, 666

[56] References Cited

U.S. PATENT DOCUMENTS

| | | | |
|---|---|---|---|
| 376,871 | 1/1888 | Elwell | 4/665 |
| 2,495,201 | 1/1950 | Snowball | 4/664 |
| 3,869,732 | 3/1975 | Garvey et al. | 4/662 |
| 4,089,073 | 5/1978 | Campbell | 4/312 X |
| 4,133,057 | 1/1979 | Rivetti | 4/DIG. 2 |
| 4,142,256 | 3/1979 | Campbell | 4/664 |
| 4,163,293 | 8/1979 | Basterfield | 4/664 |
| 4,177,527 | 12/1979 | Uhlig | 4/DIG. 2 |
| 4,366,584 | 1/1983 | Mchunna | 4/307 |
| 4,477,934 | 10/1984 | Salminen | 4/663 |

FOREIGN PATENT DOCUMENTS

| | | |
|---|---|---|
| 60-26715 | 8/1985 | Japan . |
| 60-41200 | 12/1985 | Japan . |

*Primary Examiner*—Henry K. Artis

*Attorney, Agent, or Firm*—Sandler & Greenblum

[57] ABSTRACT

This invention is constructed such that a toilet bowl and a shower are spaced apart and installed in a unit room, a flashing water unit provided with a counter having an apron is attached to the wall surface of the unit room for the shower space through hinges in such a way as it may be rotated across the shower space and the toilet bowl installing space, said counter having apron is provided with a storing part for storing the toilet bowl and covering it at the moving position toward the toilet bowl installing space and being closed in opposition to the wall surface of the unit room, thereby in case of using of the shower, the flashing water unit is positioned at the shower space and the shower space can be utilized as the flashing water application space and a toilet bowl application space is also kept, and in turn in case of non-use of the shower, the flashing water unit is rotated toward the toilet bowl installing space and a shower space is also kept and at the same time the toilet bowl installing space can be utilized as the flashing water unit application space and also the toilet bowl is stored in the counter having the apron for the flashing water unit to prevent a wetted condition of the toilet bowl caused by the shower.

16 Claims, 19 Drawing Figures

SANITARY FACILITY UNIT

BRIEF SUMMARY OF THE INVENTION

1. Field of the Invention

This invention relates to a sanitary facility unit in which a bath facility, a face washing and toilet facility and a water-closet facility are collected and installed in a certain partitioned section, and more particularly an improved sanitary facility unit which is effective particularly in such a limited installing space of relative small buildings such as a cottage, a bungalow and a mountain hut or a small-sized ship, a camping car and a trailer house or the like which have inevitably a limited space.

2. Description of the Prior Art

A well-known conventional type of a sanitary facility unit is a unit bath room. This type of unit bath room is made such that some wall panels are assembled to form a unit room and a toilet bowl, a wash basin unit applied for washing hands or face, a bath tub and a shower or the like are collected and installed in the unit room so as to save an installing space.

It is sometimes required that an entire unit is to be further compacted than that of the conventional type unit when the above-mentioned unit bath room is to be installed in a hotel or a condominium or the like.

In particular, in case of a yacht or a camping car, a substantial compact size of the unit is required. In order to fulfill the requirement of compact in size, it can be considered that the bath tub is eliminated in the unit bath room and a shower and a shower space during its use are left as a bath facility. However, even if the bath tub is eliminated, the toilet bowl and the flash unit occupy the space in the unit room independently and the shower space is still left, resulting in that only a slight saving in space in the unit room is made and so it can not be expected to have a substantial compact in size of an entire unit.

If a partition plate or something forming a curtain is not arranged between the shower space and the toilet bowl installing space, the toilet bowl may be wet with splashed water when the shower is to be used. However, if both spaces are partitioned with a curtain or the like, the shower space and the toilet bowl installation space are applied for an exclusive space for each of the spaces and so s useless space may result.

In view of the foregoing, in order to overcome the above-mentioned problems, an invention was made in which the wash basin and the toilet bowl or the like are installed on a wall or a floor of the unit room in such a way as they may be pulled out, and in case of no use of them, they are stored in the wall or the floor and they are pulled out into the unit room only when they are used.

For example, the Japanese Utility Model Publication No. 60-41200 shows that the wash basin and the water flashing unit are arranged on the wall of the unit room at the side of the toilet bowl installing position in such a way as they may be rotated and pulled out, the water flashing unit is pulled out into the room to cover the toilet bowl of the water flashing unit and the Japanese Utility Model Publication No. 60-26715 shows that a Japanese style toilet bowl is installed at the center of the floor, and further the upper surface of the toilet bowl is provided with a cover which can be opened or closed to cover the toilet bowl, and when the cover is closed during use of shower, the cover may be substantially flush with the floor surface and then the shower can be used while a user rides on the cover.

However, the system shown in the Japanese Utility Model Publication No. 60-41200 requires a space in the wall for storing the wash basin and since the required space is projected out of the wall, an effective utilization of the indoor space can be attained and it can not be expected to have a substantial compact in size of an entire unit. Even if the wash basin is pulled out into the unit room so as to cover the upper part of the toilet bowl, the side parts of the unit room are opened, so that it is not possible to prevent the toilet bowl from being wet by splashed water during sue of the shower.

In turn, the system shown in the Japanese Utility Model Publication No. 60-26715 can not be executed in case that a seating type toilet bowl is applied for the toilet bowl. Further this system is not provided with a water flashing unit for face washing and hand washing.

OBJECTS AND SUMMARY OF THE INVENTION

An object of the present invention consists in a system in which the shower space and the toilet bowl installation space are applied for the use space of water flushing unit in case of non-use or use of shower to promote a saving of space by a method wherein the water flushing unit provided with a counter having apron is mounted in such a way as it may be moved from the shower space to the toilet bowl installing space and in turn from the toilet bowl installing space to the shower space, and further the toilet bowl is covered by the counter having an apron of the water flashing unit during use if the shower so as to prevent the toilet bowl from being wet with the splashed water.

Thus, the above-mentioned object of the present invention can be attained by a sanitary facility unit in which the toilet bowl and the shower unit are spaced apart and installed in the unit room, a water flashing unit provided with a counter having an apron is fixed to the wall surface of the unit room for the shower space through hinges in such a way as it may be rotated over the shower space and the toilet bowl installing space, the above-mentioned counter having an apron is provided with a storing part for storing the toilet bowl at the toilet bowl moving position toward the installing space to cover it and being closed against the wall surface of the unit room.

That is, according to the above-mentioned sanitary facility unit of the present invention, the water flashing unit is positioned in the shower space during non-use of the shower, thereby the shower space is also used as the water flashing unit application space so as to keep the toilet bowl application space and in turn during the use of shower, the water flashing unit is rotated and moved from the shower space to the toilet bowl installation space, thus the installing space is also used as the water flashing unit application space and the shower space is kept and at the same time the counter having an apron for the water flashing unit can store the toilet bowl at its storing part and cover it.

Therefore, since each of the shower space and the toilet bowl installing space can be applied for the water flashing unit application space during non-use or use of the shower, the water flashing unit installing space and application space are not required to provide independently, its space saving is superior, an entire unit can be made substantially compact and at the same time the toilet bowl is covered by the counter having apron for the water flashing unit during use of the shower and the toilet bowl can be prevented from being wet with splashed water.

BRIEF DESCRIPTION OF THE DRAWINGS

Major features of the present invention have been described above and other features of the present invention will be more apparent as the present invention is described in reference to the accompanying drawings.

DETAILED DESCRIPTION OF THE PREFERRED EMBODIMENT

Referring now to the accompanying drawings, one preferred embodiment of the present invention will be described.

Figure 1:
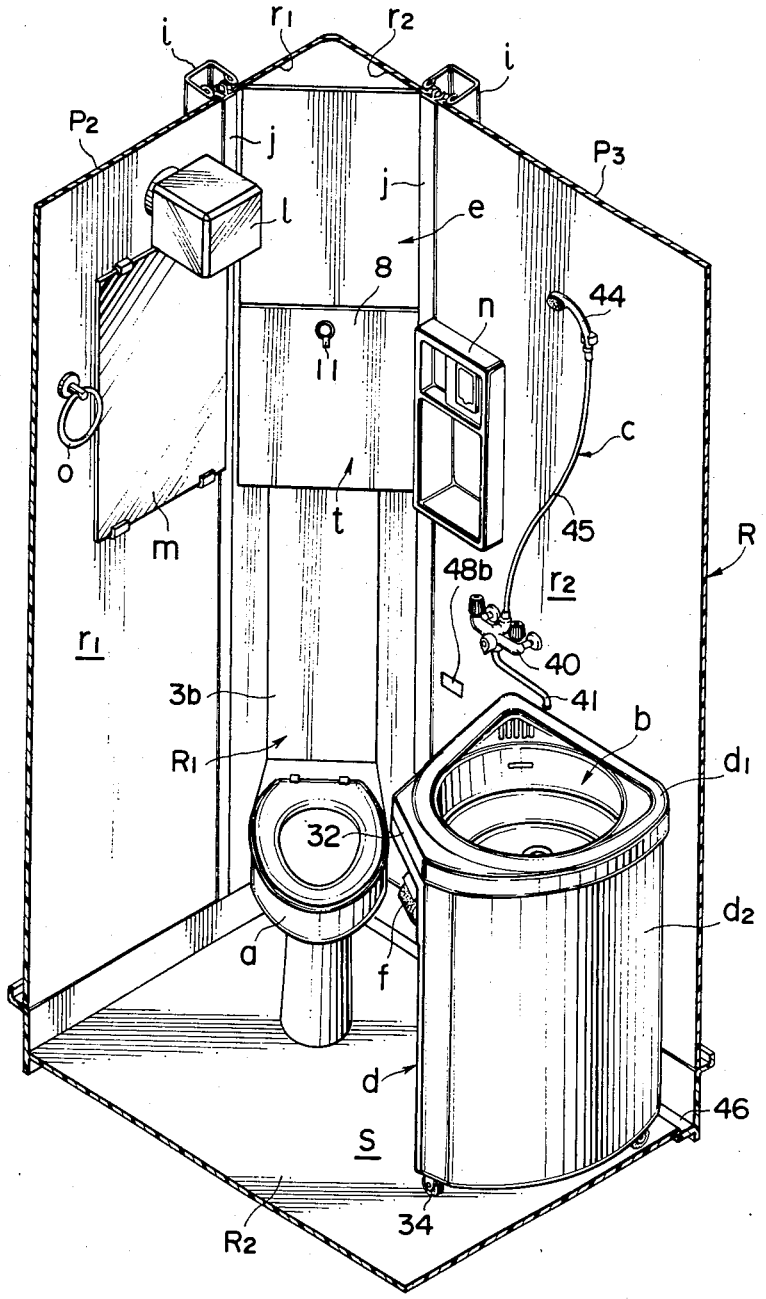
FIG. 1 is a perspective view in section for showing one preferred embodiment of a sanitary facility unit of the present invention.
Figure 2:
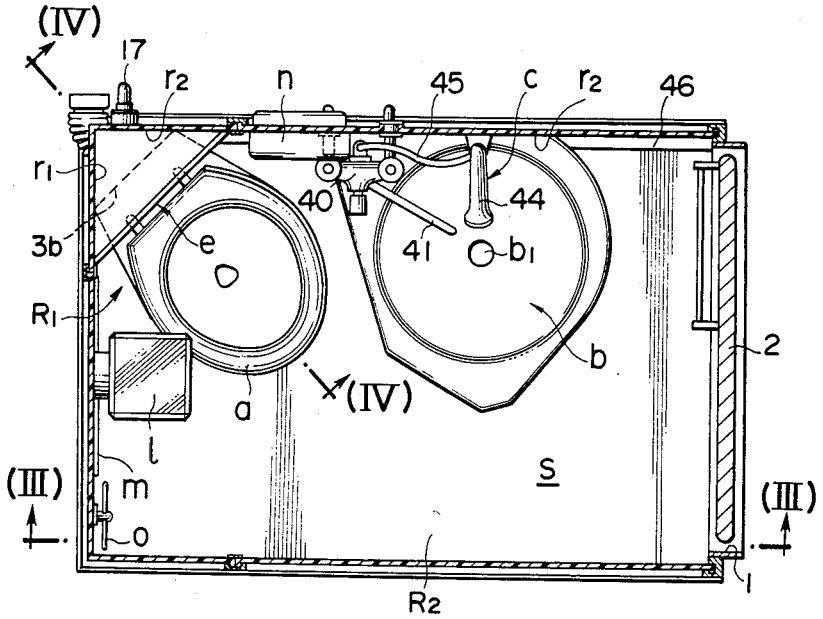
FIG. 2 is a cross sectional view of FIG. 1.
Figure 3:
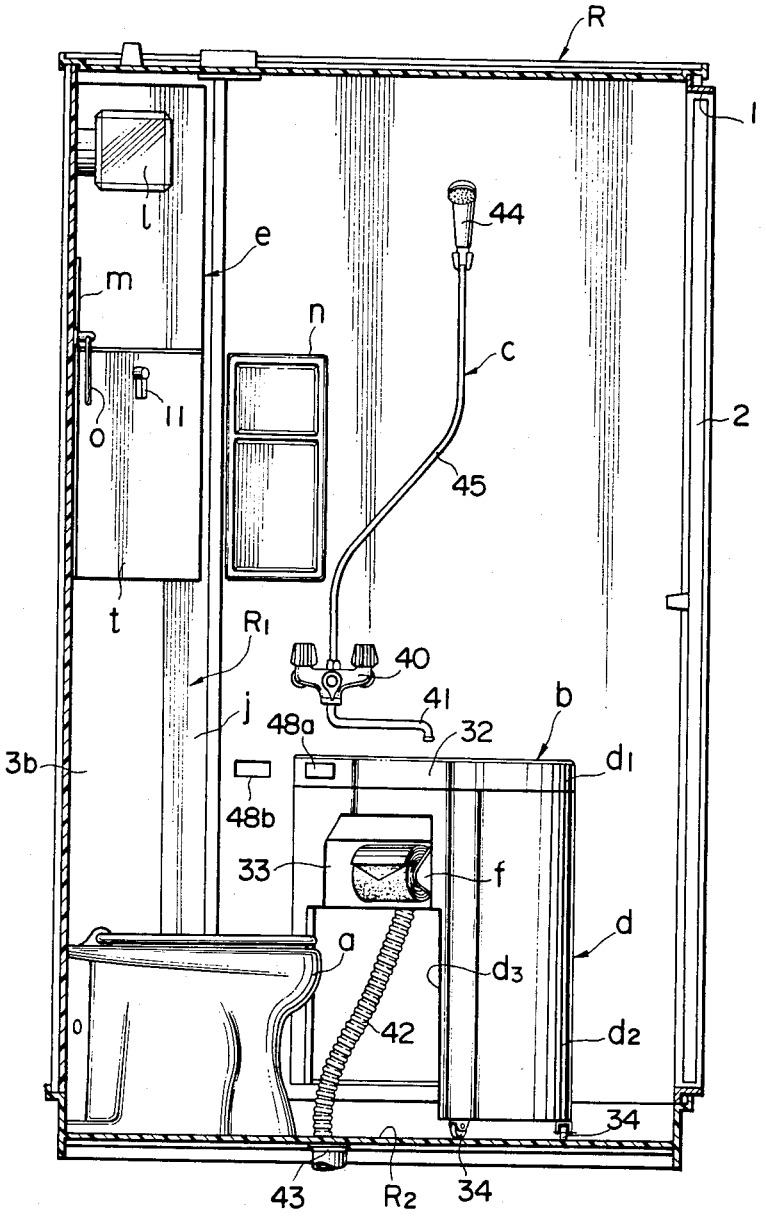
FIG. 3 is a sectional view taken along a line III—III of FIG. 2.

The sanitary facility unit of the preferred embodiment of the present invention is made such that a toilet bowl (a), a water flashing unit (b) for use in hand washing, face washing or hair washing and a shower (c) are installed in a unit room (R) as shown in FIGS. 1 to 3.

The unit room (R) is constructed by assembling the wall panels and one side surface of the unit room is provided with an entrance or exit (1) and a door (2) is arranged at the entrance or exit (1).

The toilet bowl (a) is installed at a corner part ($R_1$) in the unit room (R), and this installed structure causes a dead space formed around the rear part of the toilet bowl (a) to be reduced and a space saving is promoted.

Figure 4:
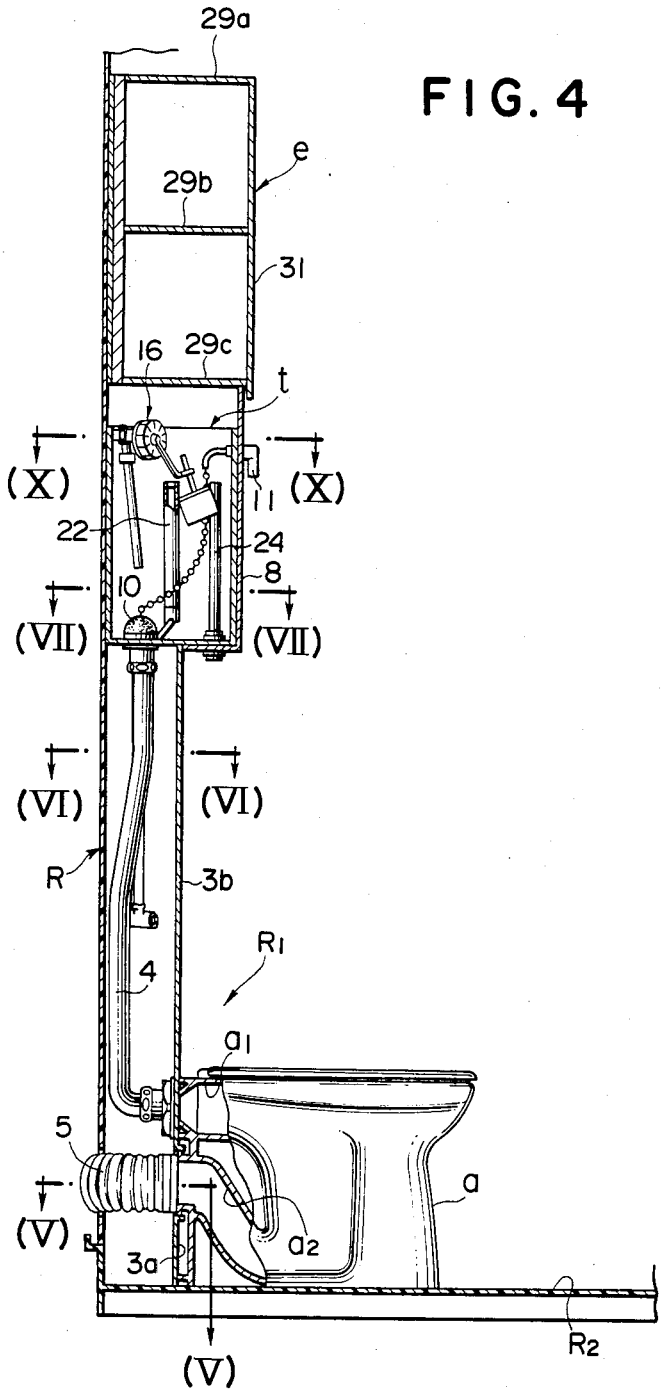
FIG. 4 is a sectional view taken along a line IV—IV if FIG. 2.

The rear end surface of the toilet bowl (a) is made flat along a rear lower cover (*3a*) as shown in FIG. 4 so as to prevent dust or the like from being accumulated around the rear part of the toilet bowl (a).

Figure 5:
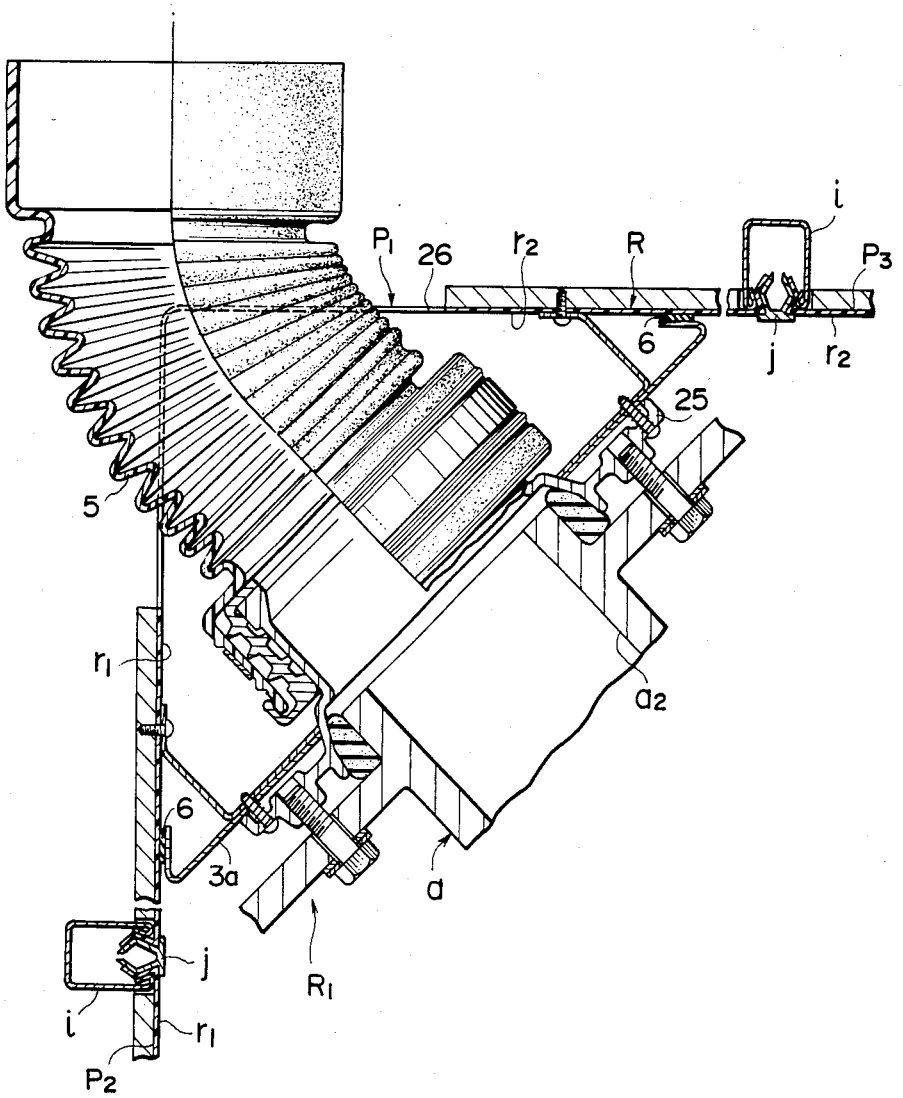
FIG. 5 is an enlarged sectional view taken along a line V—V of FIG. 4.

The lower cover (*3a*) covers and hides a flashing water supplying pipe (4) and a sewage discharging pipe (5) to be connected to the toilet bowl (a) and as shown in FIG. 5 the lower cover is removably attached between the side walls (r1) and (r2) at the corner part ($R_1$) of the unit room (R) through packings 96).

A water supplying system for the flushing water for the toilet bowl (a) is made such that a flashing water supplying pipe (4) is connected to a water feeding pipe (a1) for the toilet bowl (a) and the water supplying pipe (4) is connected to a flashing water tank (t) above the toilet bowl (a). The flashing water supplying pipe (4) is covered and hidden by an upper cover (*3b*) communicating with the upper end of the lower cover (*3a*).

Figure 6:
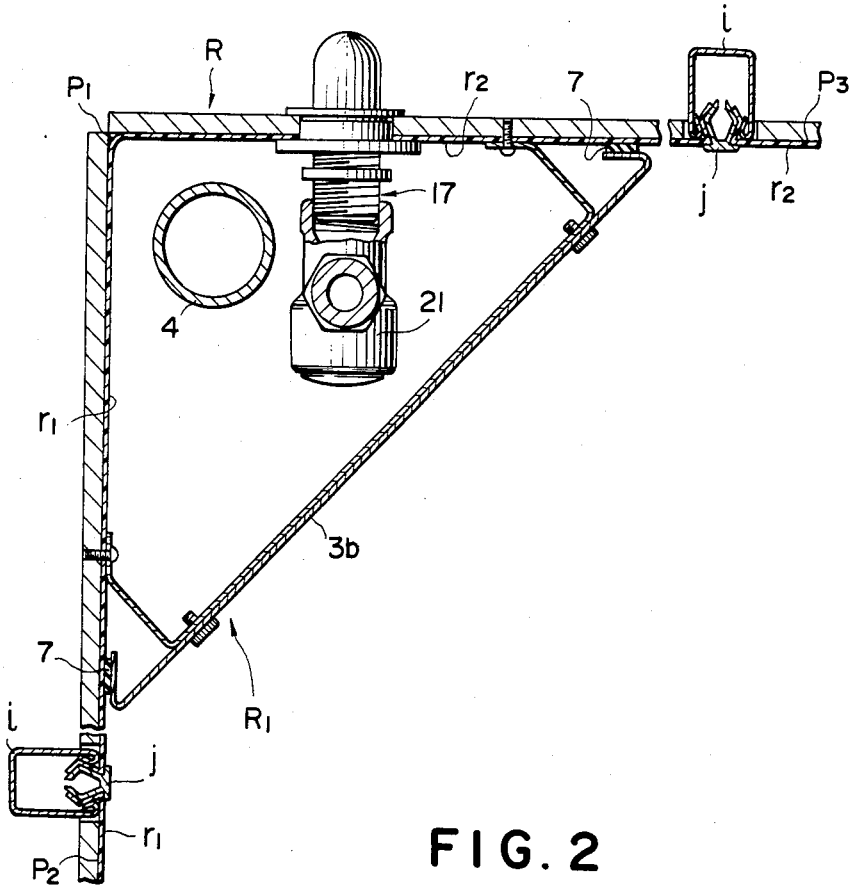
FIG. 6 is an enlarged sectional view taken along a line VI—VI of FIG. 4.

The upper cover (*3b*) is removably attached to the side walls (r1) and (r2) of the corner part ($R_1$) through packings (7) as shown in FIG. 6 in the same manner as those of the lower cover (*3a*) and acts as a wall surface for communicating the side walls (r1) and (r2) together. Quality nature, colour tone and pattern at the surface of the upper cover (*3b*) may be or may not be coincided with those of the side walls (r1) and (r2) in response to the requirement of design.

The flashing water tank (t) is arranged at a relative high position in such a way as the user may not strike his back side against it while he sits on the toilet bowl (a) during use of the toilet bowl, the tank is formed as a triangular shape as viewed in its top plan view to be coincided with the corner part ($R_1$) and made of synthetic resin material or the like, its projecting amount toward the toilet bowl (a) is restricted low and a space saving is applied. A front wall of the flashing water tank (t) is provided with a cover (8) covering an entire surface of the tank and an integral formation of the flashing water tank (t) and the side walls (r1) and (r2) of the corner part ($R_1$) adjacent to the flashing water tank (t) is applied by this cover (8).

Figure 7:
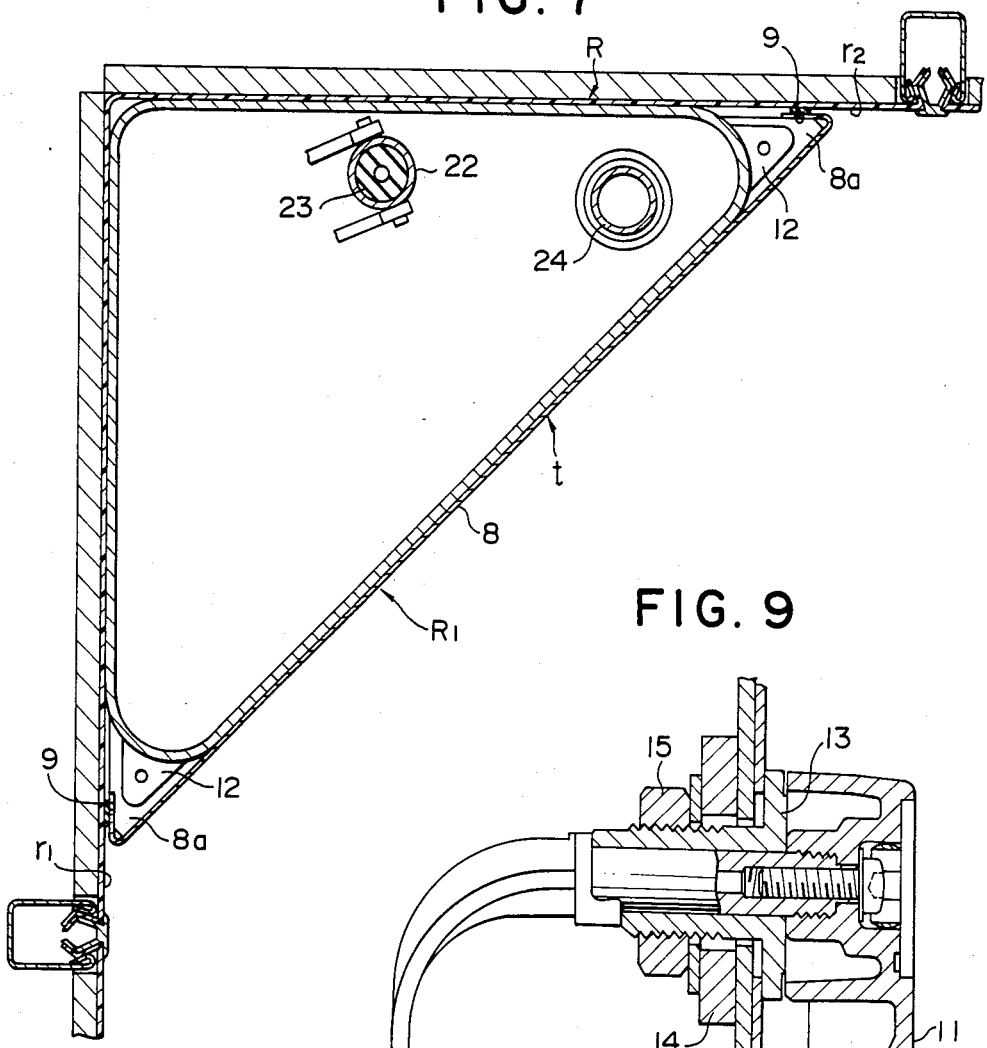
FIG. 7 is an enlarged sectional view taken along a line VII—VII of FIG. 4.

That is, the cover (8) is removably arranged between the side walls (r1) and (r2) of the corner part ($R_1$) through packings (9) as shown in FIG. 7, extends above the flashing water tank (t) and acts as a wall surface communicating with the side walls (r1) and (r2). Quality nature, colour tone and pattern of the surface of the cover (8) may be or may not be coincided with those of the side walls (r1) and (r2) in response to the design requirement.

Figure 9:
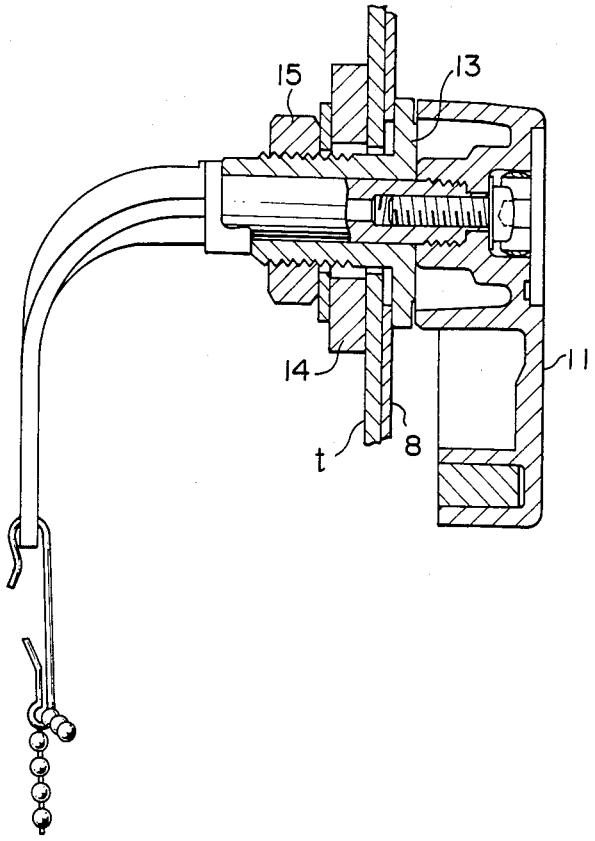
FIG. 9 is an enlarged sectional view for showing a co-fastening structure for an operation lever and a cover in a flashing water tank.
Figure 8:
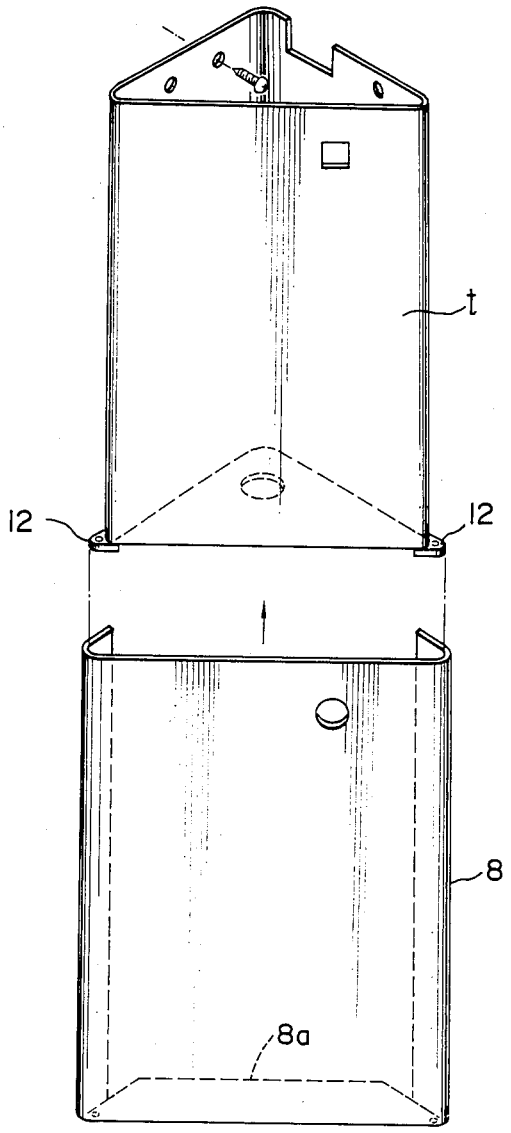
FIG. 8 is a perspective view for showing a flashing water tank and a cover.

A fixing of the cover (8) to the flashing water tank (t) is made such that the upper part of the cover (8) is co-fastened against the flashing water tank (t) together with an operating lever (11) for a drain valve (10) and in turn the lower part of the cover (8) is fastened with screws at its bent portions (*8a*) to the fixing seat part (12) of the flashing water tank (t). Co-fastening structure of the upper part of the cover (8) is made such that as shown in FIG. 9 the front surface wall of the flashing water tank (t) and the cover (8) are held between the fixing hub (13) for the operation lever (11) and a spacer (14) in the flashing water tank (t), and the operation lever (11) and the cover (8) are co-fastened by a nut (15) which is threadably fixed from within the flashing water tank (t) against the fixing hub (13). Thus, application of such a co-fastening structure causes the fixing operation of the operation lever (11) and the cover (8)

to be performed simultaneously and the assembling work can be improved.

A water supplying system for the flashing water tank (t) is constructed such that a ball tap plug (16) is arranged in the tank (t) and this ball tap plug (16) is connected to the water supplying source not shown through a water supplying pipe (17).

Figure 10:
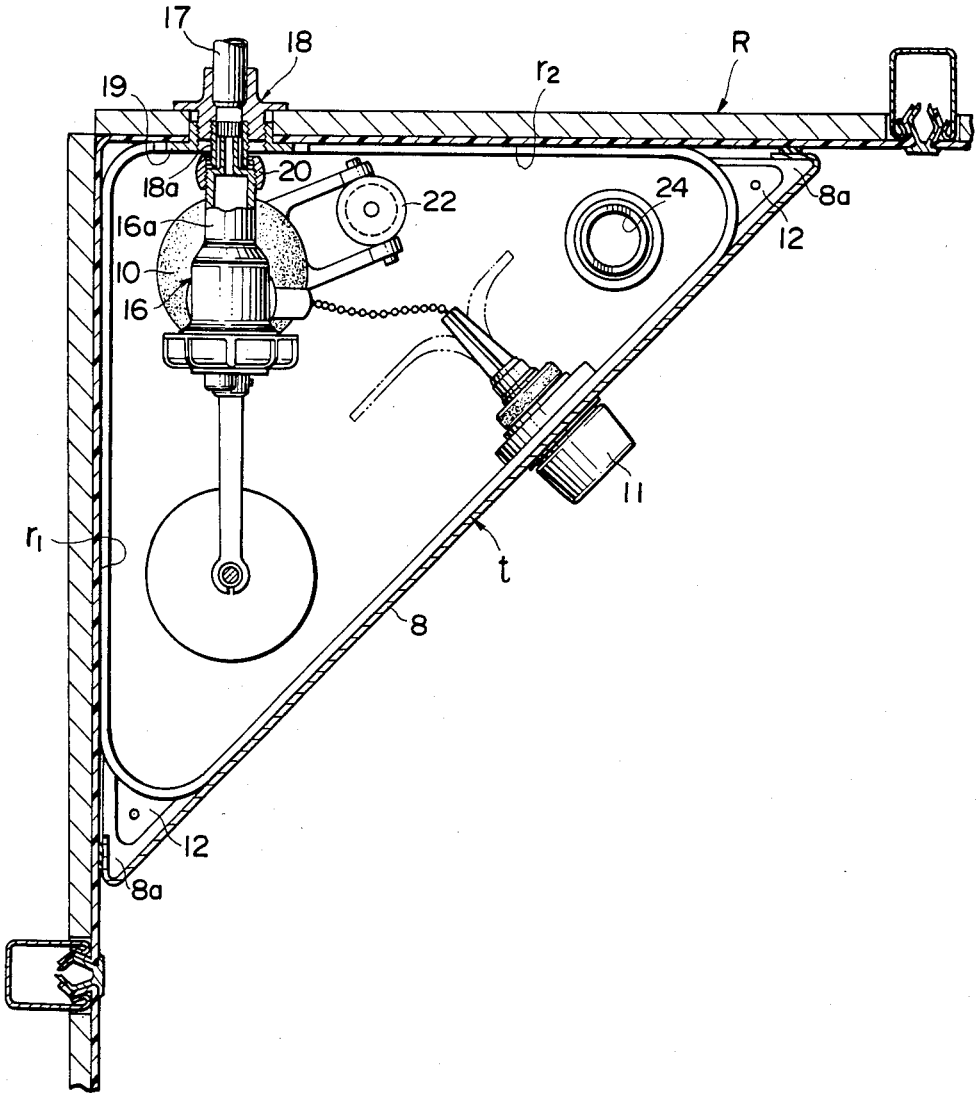
FIG. 10 is an enlarged sectional view taken along a line X—X of FIG. 4.

The ball tap plug (16) is arranged in parallel with one of the side walls (r1) and (r2) of the corner part ($R_1$), for example, (r1) in the flashing water tank (t) as shown in FIG. 10 due to a relation in which the projecting amount of the flashing water tank (t) into the toilet bowl (a) is made low as described above, and the water feeding pipe (16*a*) is removably connected to the water supplying pipe (17) in the flashing water tank (t). A connecting structure between the water feeding pipe (16*a*) and the water feeding pipe (17) is made such that a connector fitting (18) to be connected to the upper end of the water feeding pipe (17) is inserted into the side wall (r2) of the corner part ($R_1$) crossing with the water feeding pipe (16*a*) in perpendicular thereto through a flange (19), and the connection pipe (18*a*) at the extremity end of the connection fitting (18) and the water feeding pipe (16*a*) are removably connected.

Thus, in accordance with the connecting structure as described above, a connecting and fixing operation for the ball tap plug (16) and the water supplying pipe (17) is carried out at one place in the flashing water tank (t) in the unit room (R) through a cap nut (20), a more superior work is carried out as compared with the case in which each of the connection and fixing works for the ball tap plug (16) and the water supplying pipe (17) is carried out and the number of component elements can be decreased and at the same time the cap nut (20) is released in the flashing water tank (t), thereby the ball tap plug (16) is removed and the maintenance of the ball tap plug (16) can be carried out.

Figure 11:
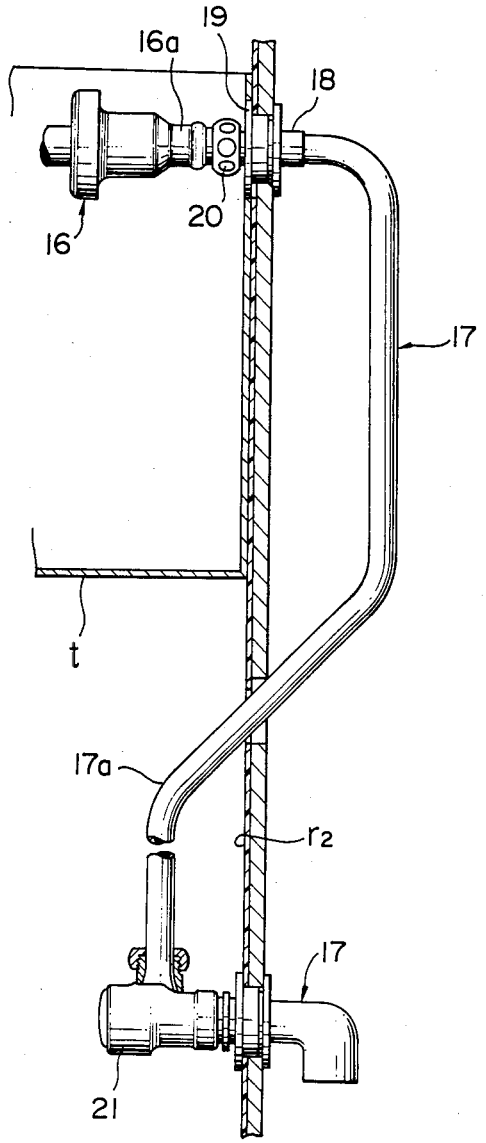
FIG. 11 is an enlarged sectional view for showing an assembly of a water feeding pipe to be connected to a ball tap plug for the flashing water tank.

Connection of the water supplying pipe (17) from the ball tap plug (16) to the supplying water source is performed such that as shown in FIG. 11 the water supplying pipe (17) guided out of the unit room (R) from the side wall (r2) is extended downwardly, thereafter inserted into the side wall (r2) and once fed into the upper cover (3*b*), the water plug (21) is connected to the feeding part (17*a*) and again inserted into the side wall (r2), guided out to the unit room (R) and then connected to the water supplying source.

A reason why the water plug (21) is connected to the water feeding portion (17*a*) into the upper cover (3*b*) consists in the fact that the water plug (21) can be opened or closed in the unit room (R) by removing the upper cover (3*b*) when the maintenance of the ball tap plug (16) is to be carried out.

Within the flashing water tank (t) is arranged an over-flow pipe (22) for preventing an over-flow caused by a trouble of the ball tap plug (16) or the like. The over-flow pipe (22) is opened at a point slightly higher than a normal water level within the flashing water tank (t) and connected to the flashing water supplying pipe (4).

Thus, since the flashing water tank (t) is placed at a relative higher position as described above, a power of the flashing water is high, a negative pressure acting on the over-flow pipe (22) becomes high, a large amount of air is sucked from the pipe (22) and mixed with the flashing water and the water supplying noise of the flashing water is high, the over-flow pipe (22) is narrowed at its upper opening area as shown in FIG. 7 by the ring (23) so as to decrease the amount of sucked air.

As a result of the narrowed upper end opening area of the over-flow pipe (22), only one over-flow pipe (22) may lack of an over-flow prevention function, so that an additional auxiliary over-flow pipe (24) is arranged in the flashing water tank (t).

This auxiliary over-flow pipe (24) is opened at the bottom part of the flashing water tank (t) to provide a direct drain of the flashing water into the unit room (R) or is connected to the water discharging system of the toilet bowl or the like to discharge surplus flashing water into the water discharging system or the like.

In turn, the water discharging system for the toilet bowl (a) is constructed such that a discharging pipe (5) of flexible hose is connected to the discharging trap (a2) for the toilet bowl (a) through a flange (25) of the lower cover (3*a*), the discharging pipe (5) is inserted into the side walls (r1) and (r2) of the corner part ($R_1$) through a through-pass hole (26) thereby guided out of the unit room (R) and then connected to the sewage pipe not shown. The side walls (r1) and (r2) of the corner part ($R_1$) through which the discharging pipe (5) is inserted are made of an angle-shaped panel ($P_1$) having no supporting column at its intermediate part as shown in FIG. 5 and both guiding-out and the fixing of the discharging pipe (5) can easily be carried out. That is, if the fixing of the discharging pipe (5) can easily be performed, an installing angle of the toilet bowl (a) in respect to the corner part ($R_1$) can freely be set.

The panel ($P_1$) is connected to the side wall panels ($P_2$) and ($P_3$) communicating with the right and left sides of the panel to form the side walls (r1) and (r2) through supporting columns (i) and the sealing members (j). At the upper position above the flashing water tank (t) in the panel ($P_1$) is fixed a storing shelf (e) for storing some small items or the like.

Figure 12:
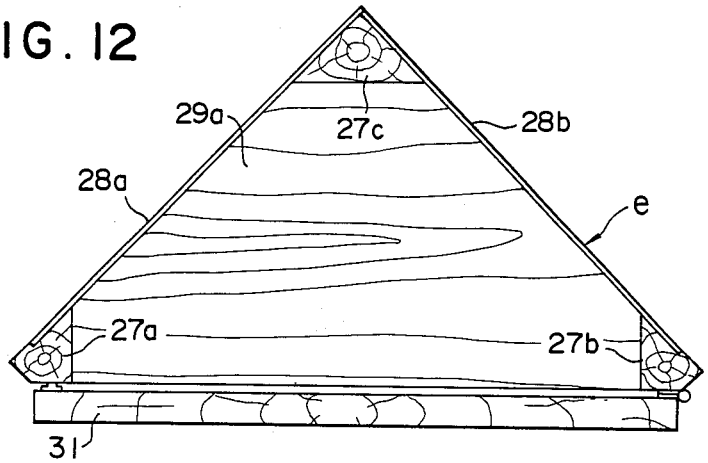
FIG. 12 is a top plan view in cross section for showing a storing shelf.
Figure 13:
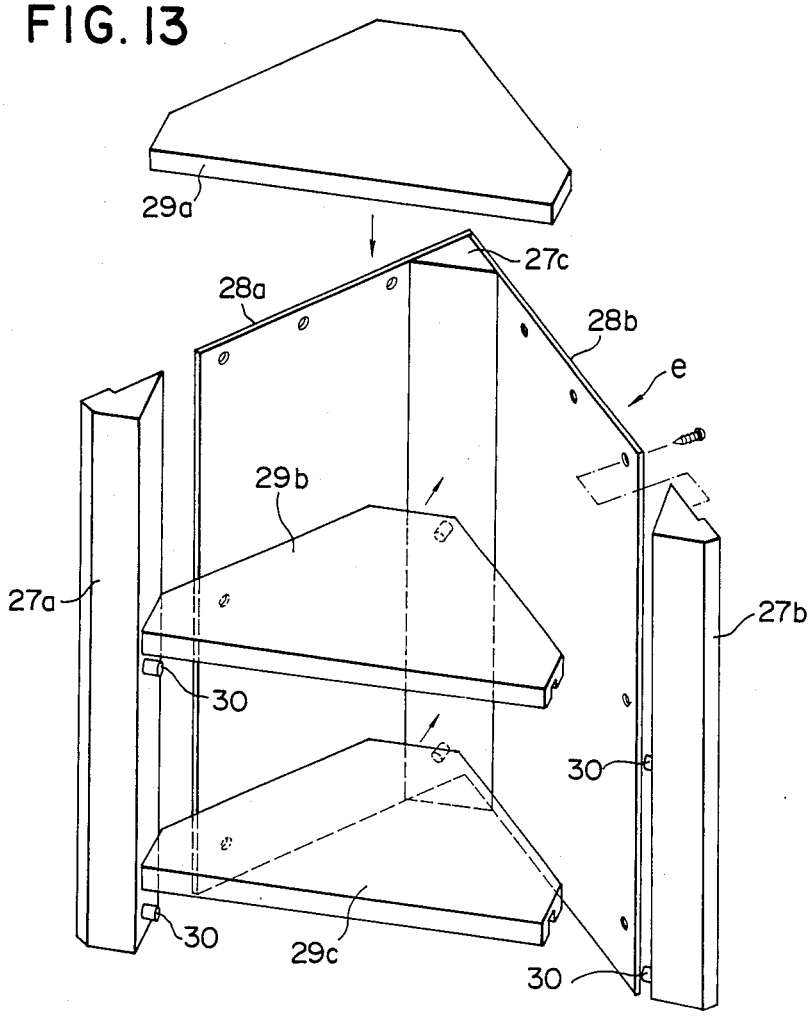
FIG. 13 is an exploded view of the shelf of FIG. 12.

As shown in FIGS. 12 and 13, the storing shelf (e) is composed of three supporting columns (27*a*), (27*b*) and (27*c*), two side plates (28*a*) and (28*b*) and three shelf plates (29*a*), (29*b*) and (29*c*) spaced apart between the side plates (28*a*) and (28*b*) and formed as a triangular shape as viewed from a top plan view which is coincided with the corner part ($R_1$). The intermediate stage shelf plate (29*b*) and lower stage shelf plate (29*c*) are removably fixed and supported on the right and left supporting columns (27*a*) and (27*b*) through pins (30), the lower stage shelf plate (29*c*) is also applied as a lid for the flashing water tank (t). Removal of these shelf plates (29*b*) and (29*c*) enables a maintenance work in the flashing water tank (t) to be performed.

Figure 14:
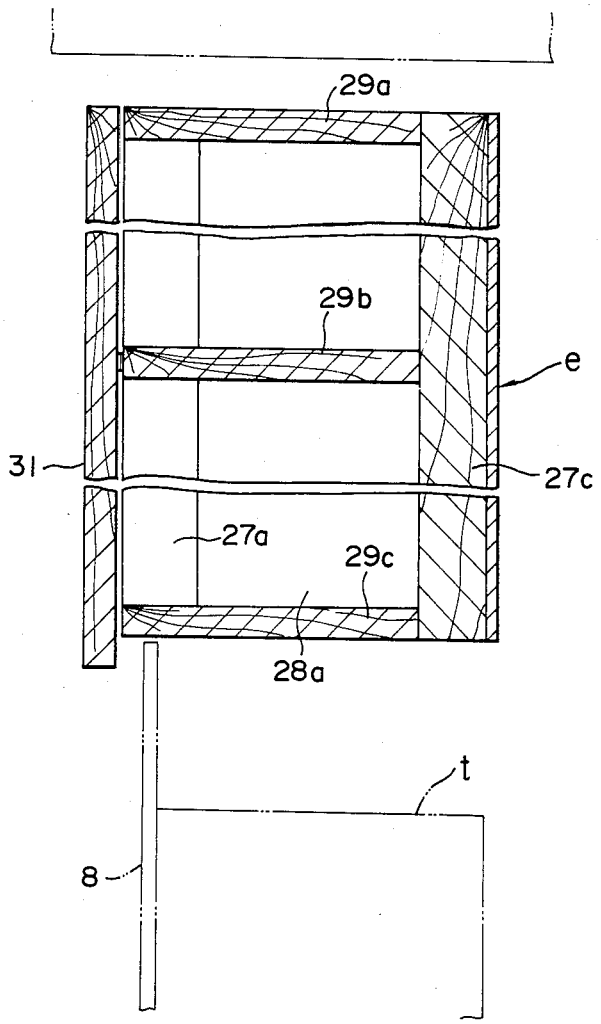
FIG. 14 is a longitudinal sectional view for showing a relation between a door for the storing shelf and the cover for the flashing water tank.

At the front surface of the storing shelf (e) is fixed a door (31). The lower end of the door (31) is extended downwardly from the lower end of the storing shelf (e) as shown in FIG. 14 and it is overlapped at its forward position against the cover (8) of the flashing water tank (t), the overlapped condition between the door (31) and the cover (8) causes a clearance between the storing shelf (e) and the flashing water tank (t) to be covered and hidden, and thus the cover (8) acting as a wall surface for communicating the side walls (r1) and (r2) of the corner part ($R_1$) is substantially extended upwardly. Quality nature, colour tone and pattern of the door (31) may be coincided with or different from those of the side walls (r1) and (r2) of the corner part ($R_1$) in response to the design requirement.

The flashing water unit (b) will be described.

The flashing water unit (b) is movably arranged between the shower space (S) in front of the shower (c) and the toilet bowl (a) installing space through a counter (d) having an apron and the counter (d) having the apron stores the toilet bowl (a) and covers it at the moving position toward the toilet bowl (a) installing space.

Figure 15:
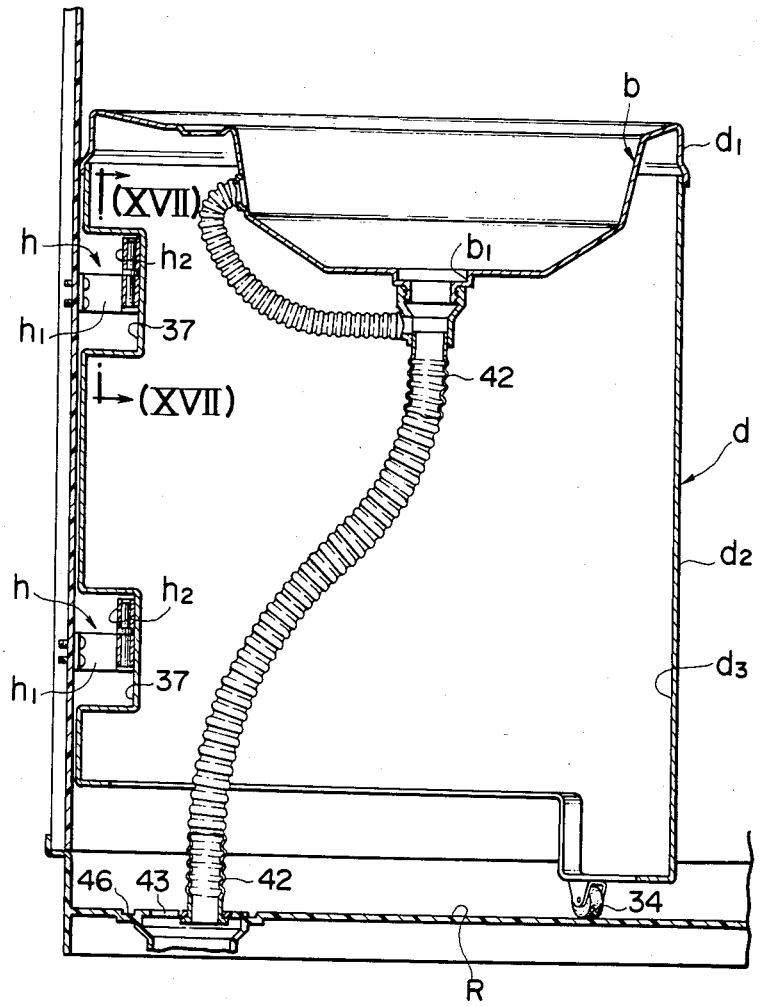
FIG. 15 is an enlarged sectional view taken along a line XV—XV of FIG. 2.
Figure 16:
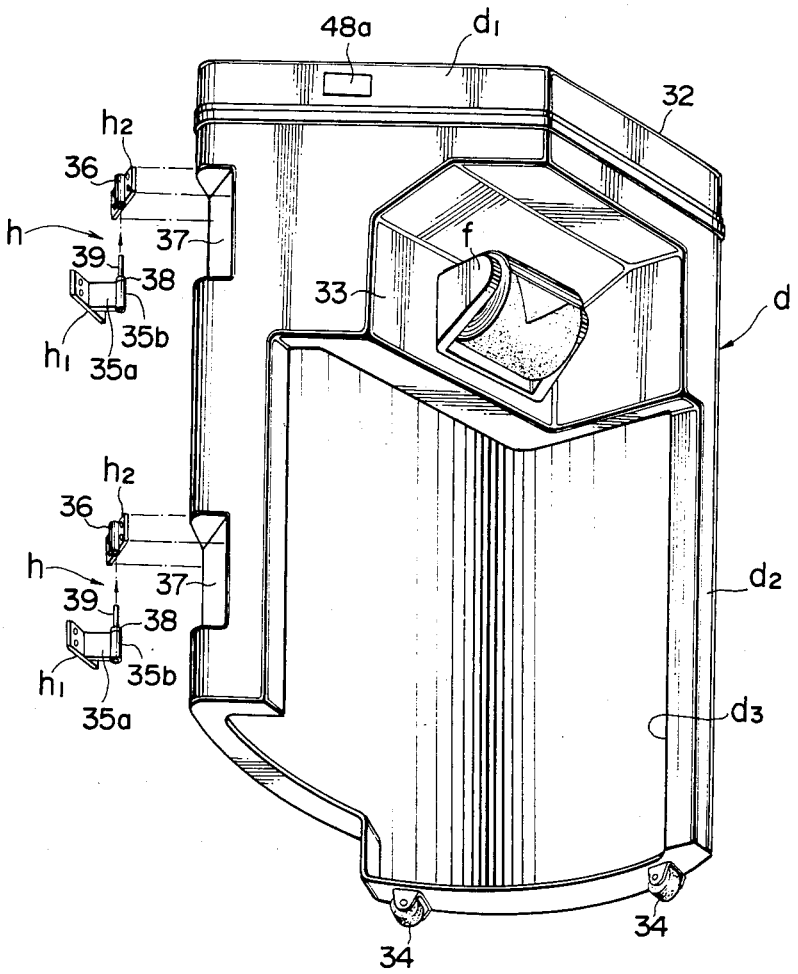
FIG. 16 is a perspective view for showing a counter having an apron and a hinge therefor.
Figure 17:
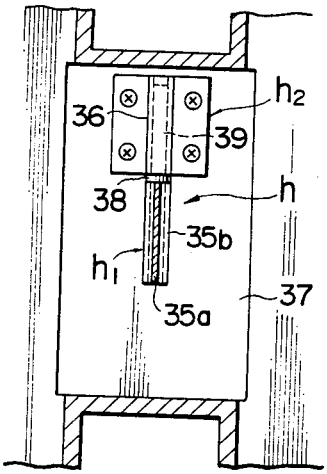
FIG. 17 is an enlarged sectional view taken along a line XVII—XVII of FIG. 15.

The counter (d) having apron is made as shown in FIGS. 15 to 17 and constructed such that a counter part (d1) is integrally formed with the flashing water unit (b) along a circumferential edge of the flashing water unit and an apron part (d2) is suspended down from the circumferential edge of the counter (d1).

The counter part (d1) is formed with a flat stopper surface (32) at its outer circumferential part, the stopper surface (32) is abutted against the wall surface in the unit room (R), that is, the upper cover (3*b*) in the preferred embodiment, and is applied for stopping the flashing water unit (b) at its moving position.

The apron part (d2) is formed separately from the counter part (d1), a toilet paper holder (f) is fixed to the side surface corresponding to the upper part above the side of the toilet bowl (a), that is, the lower side of the stopper surface (32) of the counter part (d1) through a concave part (33) under a condition in which the flashing water unit (b) is installed in the shower space (S). The wall surface communicating with the lower end of the concave part (33) is recessed and released to open and a storing part (d3) for storing the toilet bowl (a) is arranged in the opened and released part. The lower end of the apron part (d2) is contacted to the floor surface ($R_2$) in the unit room (R) through casters (34) so as to enable a movement of the flashing water unit (b) to be smoothly performed.

Means for moveably displacing the flashing water unit (b) is constructed such that the counter (d) having an apron is moveably attached and supported to the side wall (r2) at the corner part through a plurality of, for example, two hinges (h) and the flashing water unit (b) is rotated and moved between the shower space (S) and the toilet bowl (a) installing space around the hinges (h).

Each of the hinges (h) is composed of a fixing fitting (h1) fixed to the side wall (r2) and a moveable fitting (h2) attached to the apron part (d2) of the counter (d) having an apron and moveably supported in the fixing fitting (h1). The fixing fitting (h1) is provided with a supporting piece (35*a*) projected from the side wall (r2) and a supporting pipe (35*b*) is welded to the extremity end of the supporting piece (35*a*). The moveable fitting (h2) is set by screws in a concave recess (37) formed in the apron part (d2), the intermediate connection pipe (36) is abutted against the upper end of the supporting pipe (35*b*) for the fixing fitting (h1) through the resin washer (38), and the supporting shaft (39) is inserted across the connection pipe (36) and the supporting pipe (35*b*) and it is moveably and removably connected and supported in respect to the fixing fitting (h1).

Thus, according to the above-mentioned hinge structure, it is possible to cause the outer surface of the counter (d) to be approached to the side wall (r2) and make a clearance between them small due to the fact that the moveable fitting (h2) for each of the hinges (h) is positioned inside rather than outside surface of the counter (d) having apron.

Although the water discharging for the flashing water unit is carried out through a water discharging unit in which the water discharging port (41) is oscillatably connected to the hot water and cold water mixing plug (40), this water discharging unit is arranged above the fixing part of each of the hinges (h) acting as a center of rotation of the flashing water unit (b) and the water discharging can be carried out from each of the water discharging units to the flashing water unit (b) for each of the condition in which the flashing water unit (b) is placed in the shower space (S) and the condition in which the flashing water unit (b) is moved toward the toilet bowl (a).

A water discharging system for the flashing water unit (b) is constructed such that a drain water hose (42) made of flexible hose is connected to the drain water port (b1) at the bottom part of the flashing water unit (b) and the hose (42) is inserted into the drain port (43) at the floor surface ($R_2$) of the unit room.

Then, a shower (c) will be described.

The shower (c) is arranged in the side wall (r2) for fixing and supporting the flashing water unit (b) in the unit room (R) and is made such that a shower head (44) is connected to the hot water and cold water mixing plug (40) through a hose (45).

A water discharging system for the shower space (S) is made such that a drain groove (46) is formed at the floor surface ($R_2$) of the unit room and this drain groove (46) is communicated with the drain hole (43).

In the drawings, (l) designates a lighting or the like, (m) denotes a mirror, (n) indicates a shelf for storing items or the like and (o) shows a towel hanger.

In case of the above-described sanitary facility unit of the preferred embodiment, as shown in FIG. 1, during non-use of the shower (c), the flashing water unit (b) is positioned in the shower space (S), the shower space (S) is also used as a use space for the flashing water unit (b) and in turn the toilet bowl application space is kept.

The flashing water unit (b) positioned in the shower space (S) is fixed at the position with a magnetic holding unit. This magnetic holding unit is made such that a magnet (47*a*) is buried in one of circumferential surfaces of the opposed counter (d) having an apron at the position to each other and the side wall (r2) and a retracting plate (47*b*) to be retracted to the magnet (47*a*) is buried in the other.

Figure 18:
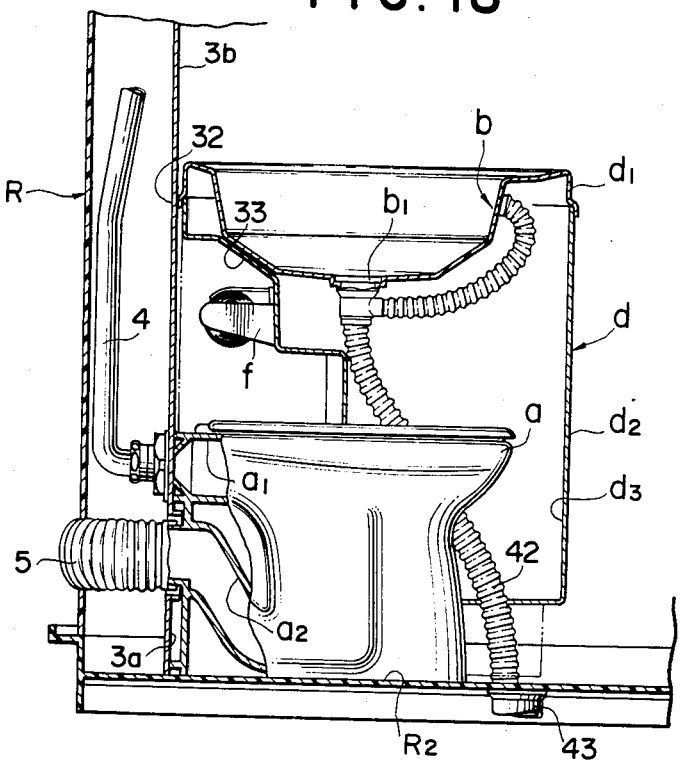
FIG. 18 is a longitudinal sectional view for showing a condition in which the flashing water unit is moved to the the toilet bowl.
Figure 19:
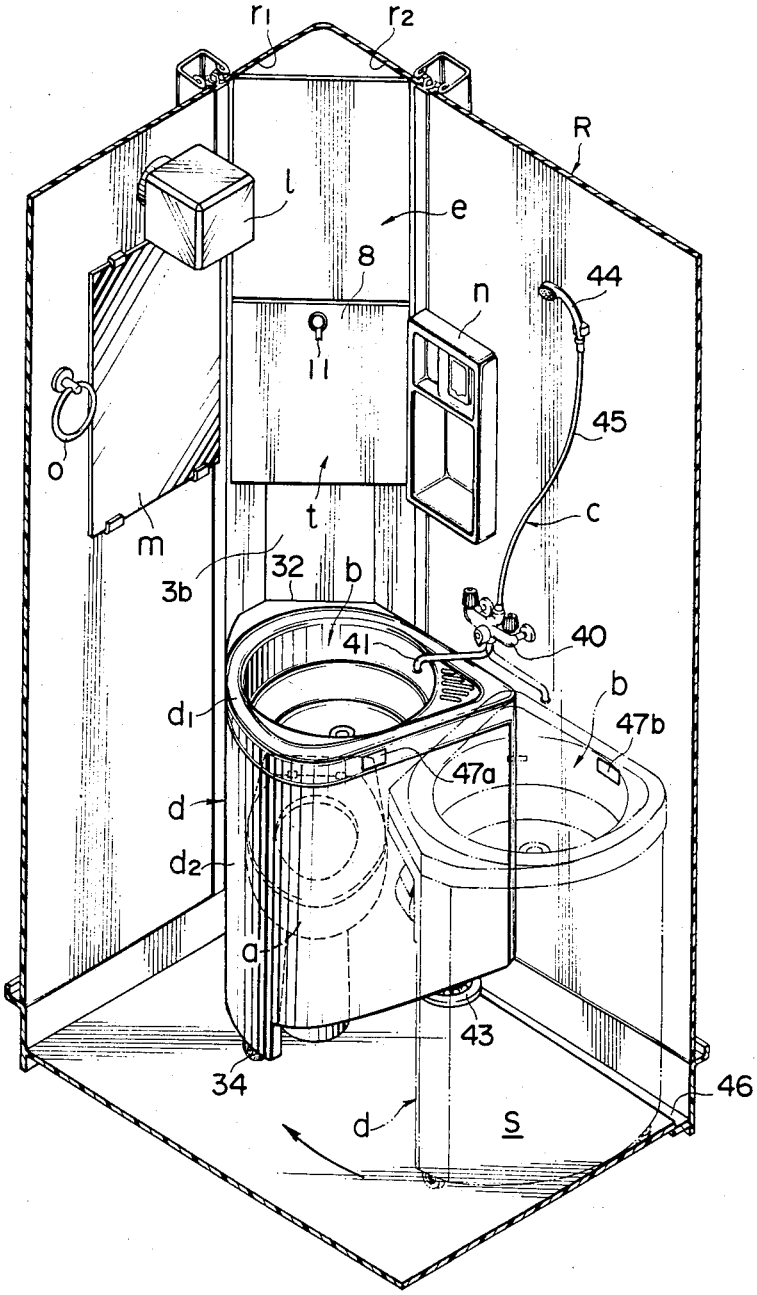
FIG. 19 is a perspective view in section.

During use of the shower (c), as shown in FIGS. 18 and 19, the flashing water unit (b) is rotated around each of the hinges (h) and moved toward the toilet bowl (a) together with the counter (d) having apron so as to keep the shower space (S) and at the same time the counter (d) having the apron of the flashing water unit (b) at the moving position stores and covers the toilet bowl (a) in the storing part (d3), the toilet bowl (a) installing space is also used as the flashing water unit (b) application space and further the toilet bowl (a) is not wetted by splashed water. The counter (d) having an apron for the flashing water unit (b) at the moving position is made such that the counter part (d1) is abutted against the upper cover (3*b*) through the stopper surface (32), so that a rolled paper unit (f) fixed within the concave part (33) below the stopper surface (32) is covered and hidden by the upper cover (3*b*) and so the paper in the rolled paper unit (f) is not wetted with the splashed water.

The flashing water unit (b) positioned in the application space for the toilet bowl (a) is fixed at the position with a magnetic holding unit. This magnetic holding unit is constructed such that each of the magnet (48*a*) and retracting plate (48*b*) is buried in the circumferential surface of the counter (d) having an apron and the side wall (r2) opposing to each other at the position in the same manner as that of the above-described magnetic holding unit.

The sanitary facility unit of the preferred embodiment of the present invention has a superior characteristic in saving space and shows a released open space in view of its sight appearance due to the fact that the toilet bowl (a), the flashing water tank (t) and the storing shelf (e) are collected at the corner part ($R_1$) in the unit room (R), the projecting amount of the flashing water tank (t) and the storing shelf (e) above the toilet bowl (a) is made small and they are integrally formed with the side walls (r1) and (r2) of the corner part ($R_1$).

What is claimed is:

1. A sanitary facility unit comprising a room housing a toliet bowl, a shower head, and a flashing water unit, said flashing water unit comprising a counter and an apron depending downwardly from said counter, said room comprising upstanding walls, a floor and a ceiling, said flashing water unit being pivotable between a first position in which said fllashing water unit is located beneath said shower head, said shower head being attached to a portion of one of said walls against which a portion of said flashing water unit is adapted to be abutted when in said first position, said shower head being located above said flashing water unit when in said first position, and a second position in which said flashing water unit is positioned over said toilet, wherein a portion of said flashing water unit is adapted to abut a second one of said walls when in said second position, wherein when said flashing water unit is in said second position an portion of said floor of said room is positioned directly beneath said shower head, said apron defining a storage space under said counter and above said floor, said storage space being adapted to receive said toilet bowl when said flashing water unit is pivoted into said second position, wherein said walls of said sanitary facility unit define an uncompartmented chamber which houses said toliet, said shower head, and said flashing water unit.

2. A sanitary facility unit in accordance with claim 1 wherein said toilet bowl is positioned in a corner of said room.

3. A sanitary facility unit in accordance with claim 2, further comprising a flashing water tank comprising means for supplying flashing water to said toilet bowl, said tank being located in said corner of said room and above said toilet bowl, said apparatus further comprising a flashing water supply pipe which fluidically connects said flashing water supply tank to said toilet bowl, said flashing water supply pipe being covered by a cover attached at an angle to adjacent side walls of said room adjacent said corner.

4. A sanitary facility unit in accordance with claim 3 wherein said room further comprises a storage shelf under which said water supply tank is positioned, wherein sides of said storage shelf are in abutment with at least two of said side wall of said room.

5. A sanitary facility unit in accordance with claim 4 wherein said storage shelf is positioned above said flashing water tank, a plurality of additional shelf plates being removably positioned in spaced relationship beneath said storage shelf, wherien the lowest one of said plates comprises a lid for said flashing water tank.

6. A sanitary facility unit in accordance with claim 1 wherein said room further comprises a unit for discharging water from a central portion of said flashing water unit.

7. A sanitary facility unit in accordance with claim 1 wherein said apron includes a concave surface for receiving said toilet bowl when said flashing water unit is in said second positiion, said concave surface of said apron further comprising means for holding a roll of toilet paper therein.

8. A sanitary facility unit in accordance with claim 1 wherein said apron has a lower surface adjacent to and spaced upwardly from the floor of said room, a plurality of wheels being attached to said lower surface of said apron and being supported by said floor, said wheels comprising means for rolling said flashing water unit between said first position and said second position.

9. A sanitary facility unit in accordance with claim 1 wherein said flashing water unit, when in said second position, comprises means for concealing said toilet bowl from the view of a user in said room.

10. A sanitary facility unit in accordance with claim 1 wherein a flexible conduit is connected to the underside of said counter and to an aperture in said room floor for draining water from said flashing water unit through said floor.

11. A sanitary facility unit comprising a toilet bowl, a shower head, and a sink, said sink comprising a counter and an apron depending downwardly from said counter, said sanitary facility unit comprising a room having a plurality of upstanding walls, a floor and a ceiling, said sink being pivotable between a first position in which at least a portion of said sink abuts one of said walls and is located beneath said shower head, said shower head being attached to a portion of said one of said walls, wherein when said sink is in said first position, said shower head is located above said sink, and a second position in which at least a portion of said sink abuts a second of said walls and is positioned over said toilet, wherein, when said sink is in said second position, an unoccupied portion of said floor of said sanitary facility unit is positioned directly beneath said shower head, said apron defining a storage space between said sink and said floor and comprising means for receiving said toilet when said sink is pivoted into said second position, said walls of said sanitary facility unit defining an uncompartmented room which houses said toilet, said sink, and said shower head, wherein said sink further comprises means attached to a bottom surface of said sink for facilitating pivoting motion of said sink between said first and said second positions, said sink further comprising a flexible hose for fluidically communicating the interior of said sink with the underside of said floor, said facility unit further comprising means for detachably securing said sink to said walls in each of said first and second positions.

12. A sanitary facility unit in accordance with claim 1, further comprising means for detachably securing said flashing water unit to said walls in both of said first and second positions.

13. A sanitary facility unit in accordance with claim 12, wherein said detachably securing means comprise complementary magnetic means including at least one magnet on said apron and at least one plate on one of said walls.

14. A sanitary facility unit in accordance with claim 13 wherein there are two spaced plates on said one wall, and two magnets on said flashing water unit.

15. A sanitary facility unit in accordance with claim 1, wherein said flashing water unit includes a sink.

16. A sanitary facility unit in accordance with claim 11, wherein said means for facilitating pivoting motion of said sink comprise a plurality of wheels attached to a bottom surface of said apron.

* * * * *

UNITED STATES PATENT AND TRADEMARK OFFICE

CERTIFICATE OF CORRECTION

PATENT NO. : 4,718,131

DATED : January 12, 1988

INVENTOR(S) : Ryuzo KITAMURA et al.

It is certified that error appears in the above-identified patent and that said Letters Patent is hereby corrected as shown below:

At column 1, line 47, delete "s".

At column 1, lines 52-53, change "in case of no use of them" to ---when not in use---.

At column 2, line 13, change "sue" to ---use---.

At column 2, lines 15-16, change "in case that" to ---unless---.

At column 2, line 18, insert ---,--- after "Further".

At column 2, line 22, change "in" to ---of---.

At column 2, line 24, insert ---of--- after "use" and before "space".

At column 2, line 24, insert ---the--- after "of" and before "water".

At column 2, line 25, insert ---the--- after "of" and before "shower".

At column 2, line 28, insert ---an--- before "apron".

At column 2, line 33, change "if" to ---of---.

At column 2, line 54, insert ---the--- after "of" and before "shower".

At column 2, bottom line, insert ---an--- after "having" and before "apron".

At column 3, line 10, insert ---a--- after "in" and before "section".

At column 3, line 17, change "if" to ---of---.

At column 3, line 48, delete "the" (second occurrence).

UNITED STATES PATENT AND TRADEMARK OFFICE

CERTIFICATE OF CORRECTION

PATENT NO. : 4,718,131

DATED : January 12, 1988

INVENTOR(S) : Ryuzo KITAMURA et al.

It is certified that error appears in the above-identified patent and that said Letters Patent is hereby corrected as shown below:

At column 5, lines 55-56, change "a trouble of the ball tap plug" to ---trouble with the ball tap plug---.

At column 6, line 3, delete "of" after "lack" and before "an".

At column 8, line 3, change "condition" to ---conditions---.

At column 8, line 4, delete "the condition".

At column 8, line 13, change "Then," to ---Now, ---.

At column 8, line 26, insert ---the--- after "In" and before "case".

At column 8, line 35, insert ---the--- after "of" and before "circumferential".

At column 8, line 44, insert ---an--- after "having" and before "apron".

At column 9, line 13 (i.e., in claim 1, line 2), change "toliet" to ---toilet---.

At column 9, line 18 (i.e., in claim 1, line 7), change "fllashing" to ---flashing---.

At column 9, line 29 (i.e., in claim 1, line 18), change "an" to ---a---.

At column 9, line 36 (i.e., in claim 1, line 25), change "toliet" to ---toilet---.

At column 9, line 55 (i.e., in claim 4, line 5), change "wall" to ---walls---.

UNITED STATES PATENT AND TRADEMARK OFFICE

CERTIFICATE OF CORRECTION

PATENT NO. : 4,718,131

DATED : January 12, 1988

INVENTOR(S) : Ryuzo KITAMURA et al

It is certified that error appears in the above-identified patent and that said Letters Patent is hereby corrected as shown below:

At column 9, line 60 (i.e., in claim 5, line 5), change "wherien" to ---wherein---.

Signed and Sealed this

Fourth Day of September, 1990

*Attest:*

*Attesting Officer*

HARRY F. MANBECK, JR.

*Commissioner of Patents and Trademarks*